United States Patent [19]

Boucherie

[11] Patent Number: 4,688,857

[45] Date of Patent: Aug. 25, 1987

[54] AUTOMATIC FEEDING ARRANGEMENT FOR FIBRE MAGAZINE AND/OR FIBRE CASSATTES OF BRUSH-MAKING MACHINES

[75] Inventor: Leonel Boucherie, Roeselare-Rumbeke, Belgium

[73] Assignee: Firma G.B. Boucherie, Belgium

[21] Appl. No.: 794,762

[22] Filed: Nov. 4, 1985

[30] Foreign Application Priority Data

Nov. 8, 1984 [BE] Belgium ..... 2/60539

[51] Int. Cl.[4] ..... A46D 1/04

[52] U.S. Cl. ..... 300/7; 83/924; 300/2; 414/412; 414/416

[58] Field of Search ..... 300/2, 7; 414/224, 412, 414/416; 53/381 R; 83/924

[56] References Cited

U.S. PATENT DOCUMENTS

| | | | |
|---|---|---|---|
| 2,356,121 | 8/1944 | Cave et al. | 300/7 |
| 3,863,790 | 2/1975 | Kanarek | 414/416 X |
| 3,889,442 | 6/1975 | Grahn et al. | 414/412 X |
| 4,036,380 | 7/1977 | Berry et al. | 414/412 |
| 4,339,221 | 7/1982 | Mitzel et al. | 414/416 X |
| 4,414,730 | 11/1983 | Ohmura et al. | 83/924 X |
| 4,457,123 | 7/1984 | Hoehn | 414/412 X |

FOREIGN PATENT DOCUMENTS

| | | | |
|---|---|---|---|
| 881914 | 9/1981 | Belgium | 300/2 |
| 2046147 | 11/1980 | United Kingdom | 83/924 |

*Primary Examiner*—Howard N. Goldberg
*Assistant Examiner*—Joseph M. Gorski
*Attorney, Agent, or Firm*—Bacon & Thomas

[57] ABSTRACT

An arrangement for automatically feeding fibres to the cassette of a brush-making machine, the arrangement including a bundle magazine for storing cylindrical bundles of wrapped fibres, a bundle chamber for sequentially receiving the wrapped fibre bundles wherein a knife disposed within the chamber serves to cut through each bundle wrapper, a mechanism for completely removing each cut wrapper from the loose fibres, a pair of tongs for gripping the loose fibres and maintaining them in a parallel disposition, and a conveyor for moving the gripped fibres to the fibre cassette of the brush-making machine.

17 Claims, 13 Drawing Figures

3
1
13
39
34
40
36
14
38
37
41
13
28
19
17
2
47
18
31

3
1
13
39
34
40
36
38
37
14
41
28
19
17
2
13
31
18

AUTOMATIC FEEDING ARRANGEMENT FOR FIBRE MAGAZINE AND/OR FIBRE CASSATTES OF BRUSH-MAKING MACHINES

The present invention relates to a feeding arrangement for fibre magazines and/or cassettes, in other words to an arrangement for automatically filling up either fibre magazines that are mainly used in brush-making machines, or cassettes that are intended for being used in brush-making machine.

It is known in brush-making machines that during the production of brushes the brush fibres are fed into such a machine either from a fibre channel that is filled with loose fibres and is fixed to the brush-making machine, of from cassettes which have been filled with fibres beforehand, wherein it is known that feeding the fibres into the fibre channel or the cassettes of the arrangements known up to now occurs mainly by hand.

Since the fibres, that are either synthetic or vegetable, or consist of animal hairs or bristles, mostly are delivered by the fibre manufacturers in the form of bundles of a certain length, these fibre bundles being held together by an envelope formed by a paper or foil wrapper, a small thread, a small band, a rubber band or any other means, the machine operator or any other person has to remove said envelope or wrapper every time in order to feed the loose fibres into the fibre magazine or cassette.

So, the machine operator has successively to take every fibre bundle separately in his hand, remove the wrapper either by tearing it or cutting it, or by sliding the fibres out of it, and finally carefully feeding the loose fibres into the fibre magazine, whereupon small bundles of fibres are separated therefrom by a taking-off arrangement and placed into the feeding arrangement.

It appears from the foregoing that manually feeding the fibres is time-consuming. Moreover, the relatively reduced capacity of such fibre magazine requires a regular intermediary of the machine operator, which necessitates this person to be permanently present.

In workshops wherein a plurality of brush-making machines with manual fibre input are set up, also several operators have to be present in order to guarantee the continuity of the production process, which constitutes an undesirable cost-forming factor.

In the past, arrangements already have been proposed for reducing to a minimum the manual acts with respect to filling up the fibres. In other words, it has been tried to considerably enhance the operating time of the brush-making machines without the intermediary of a machine operator or other person in order to have several machines operated by only one person and/or to trust that same person with additional activities, such as the control of the manufactured product as well as its packing.

Also paper grippers are known, which are capable of removing in a simple way a paper wrapper from a fibre bundle. These paper grippers, whose operation is based on the perforation of the wrapper by means of a number of small pins that are practically perpendicular thereto, these pins carrying away the wrapper upon withdrawing themselves, present the disadvantage of being relatively unreliable because the adherence between said wrapper and said pins perforating it perpendicularly is limited indeed.

With the purpose of realizing the further automation of brush-making machines, the feeding arrangement for fibre magazines or fibre cassettes according to the present invention provides the automatic supply of the fibre bundles, the removal of the wrapper or the like, gripping and conveying the loose fibres, and picking them up in the fibre channel and/or the fibre cassettes, wherein the aforesaid and other disadvantages do not arise.

Such a further sophisticated automation with this feeding arrangement can be applied to brush-making machines with simple fibre magazines as well as to those having multiple fibre magazines, which are of the so-called oscillating type or not.

It is clear that in the most preferred embodiment of the present invention the feeding arrangement is carried out as a loose unit, that either can be connected to a brush-making machine or can be used separately for filling fibre cassettes or the like. At the same time, such a feeding arrangement can be integral with the new brush-making machines during the construction of the latter.

For that purpose, the feeding arrangement for fibre magazines and/or fibre cassettes being the object of the present invention mainly consists of the combination of a bundle magazine to which the fibres are supplied in bundle form; a bundle chamber that is provided with a knife for cutting the wrapper; an arrangement for removing said wrapper; a pair of fibre-gripping tongs for gripping the loose fibres; and a conveyor part for bringing the fibres in the fibre magazine or the fibre cassette.

In order to better demonstrate the features of the present invention, a preferred embodiment as well as some variants of the composing parts of such a feeding arrangement will be shown hereinafter without limiting it thereto and with reference to the following figures wherein:

FIG. 1 represents a perspective view of a feeding arrangement for fibre magazines according to the present invention;

FIGS. 2 to 8 schematically represent the operation of said feeding arrangement;

Figure 1:
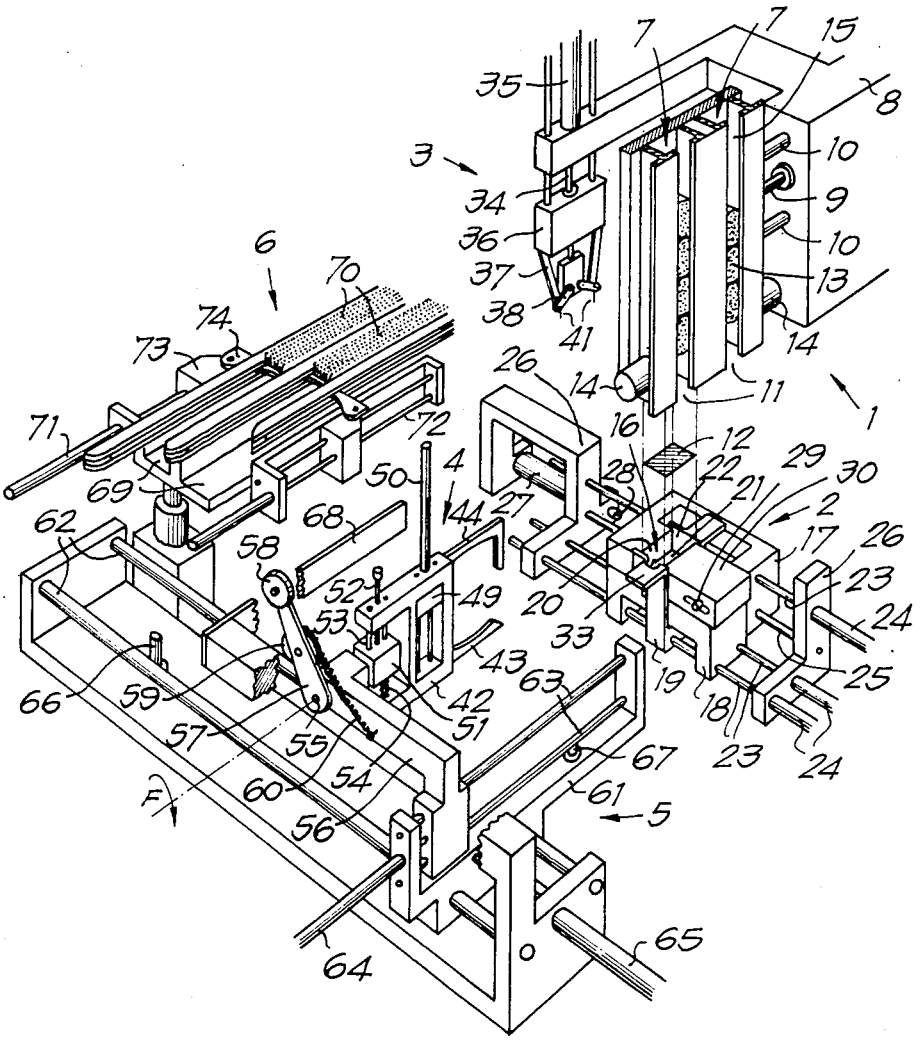

As represented in FIG. 1, the feeding arrangement for fibre magazines in this embodiment mainly consists of a bundle magazine 1, a slidable bundle casing 2, a paper gripper 3, a pair of fibre-gripping tongs 4 and a conveyor part 5 that is connected to the fibre magazine 6 of a brush-making machine.

The bundle magazine 1 is provided with at least one bundle channel 7. In the case of embodiments that are provided with several, mostly adjacent bundle channels 7, such as e.g. in FIG. 1, the bundle magazine 1 preferably is fixed slidably to a part 8 of a frame. By means of the piston rod 9 and the guiding rods 10, one of the bundle-channel outlets 11 at choice can be brought above a well-determined discharge place 12. The fibre bundles 13, placed in the bundle channels 7 that are mostly directed upward vertically or obliquely, which fall down under the influence of gravity, are retained by controlled pneumatic or electromagnetic stopping mechanisms 14, of which one has been provided at every bundle-channel outlet 11.

The rectangular bundle channels 7 are provided over their entire length at one of their sidewalls with a slot 15.

For clarity's sake, the bundle magazine 1 is represented in FIG. 1 at a higher place. In reality, the bundle-channel outlets 11 find themselves just above the bundle casing 2.

The bundle casing 2 mainly consists of a bundle chamber 16, which is formed by three slides which separately from one another but in the same sense are slidable, viz. the main slide 17, the bottom slide 18 and the intermediate slide 19, which form the end walls 20, the bottom 21 and the sidewalls 22 respectively of said bundle chamber 16.

In the condition of rest and/or of start of the slides, the bundle chamber 16 is just underneath the discharge place 12 of the bundle magazine 1.

The main slide 17, the bottom slide 18 and the intermediate slide 19 are moved by means of the piston rods 23 of the pneumatic cylinders 24.

In the embodiment according to FIG. 1, the above-said three slides are supported by the three piston rods 23 themselves to which they are attached, and a fixed guiding bar 25, both of which being carried by the parts 26 making part of the abovesaid frame.

The bottom slide 18 and the intermediate slide 19 can take two positions. As the main slide 17 can be retained during its movement by a stop 28 operated by a piston cylinder 27, this slide can also take an intermediate position, i.e. three positions in all.

It is clear that for realizing this, the piston surface of the piston cylinder 27 has to be greater than the piston surface of the pneumatic cylinder 24 which is responsible for the motion of the main slide 17.

For being able to adapt the bundle chamber 16 to the length of fibre bundles 13, the main slide 17 is provided with a part 30 that can be adjusted by means of a screw 29.

Figure 2:
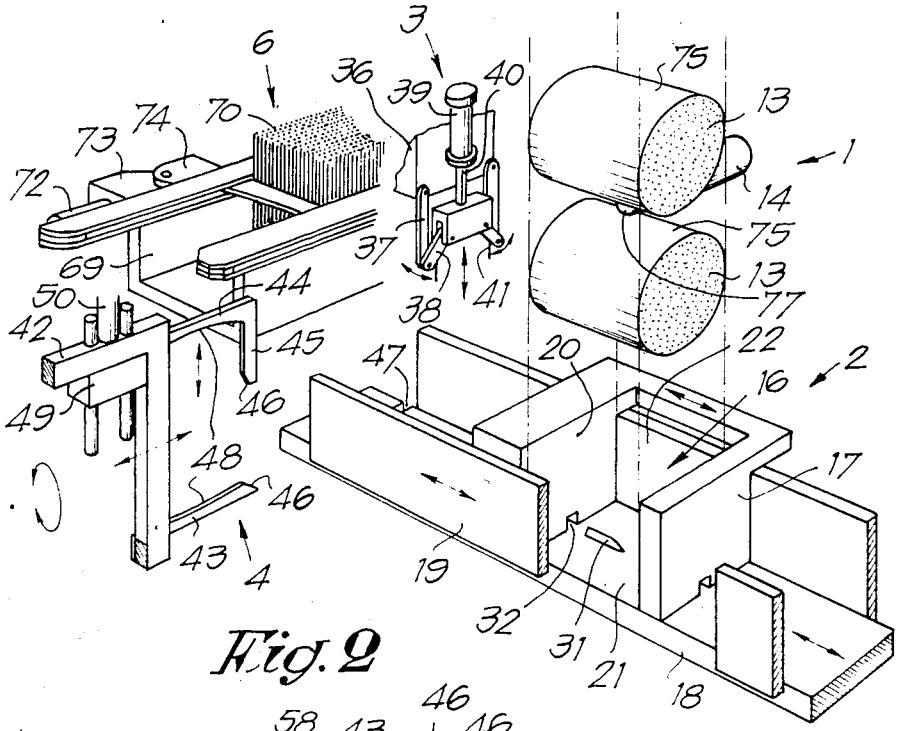

As appears more clearly from FIG. 2, the bottom 21 of the bundle chamber 16 is provided with a knife 31 that is fixed to the top side of the bottom slide 18. The end walls 20 of the bundle chamber 16 at suitable places are provided with grooves 32 wherein the knife 31 can be displaced.

Further, as is represented in FIG. 1, the sidewalls 22 of the bundle chamber 16 can still be provided at their top sides with horizontally extending flanges 33, the purpose of which will be explained hereinafter.

It is clear that the bundle casing 2 is slidable in such a way that in one position the bundle chamber 16 finds itself underneath the discharge place 12 and in another position underneath the paper gripper 3.

The paper gripper 3, which e.g. is attached to part 8 of the frame, consists of an element 36 that can be moved up and down by means of a piston rod 34 of a position cylinder 35, a pivotable rod mechanism consisting of two pairs of rods 37-38, a second small piston cylinder 39 fixed to the element 36 (represented in FIG. 2), whose piston rod 40 is connected to the rod mechanisms 37-38, and at least one couple of small pins 41 pointing vertically downward and mounted on rod 38, all this in such a way that the pins 41 at the bottom side of paper gripper 3 are allowed to move up and down by means of the piston cylinder 35 and also can be swung apart with respect to one another by means of the small piston cylinder 39.

The paper gripper 3 is provided with a paper-removing arrangement (not represented in the drawings) consisting, e.g., of a pneumatically, electrically or mechanically operated stop or gripper clamp.

Figure 13:
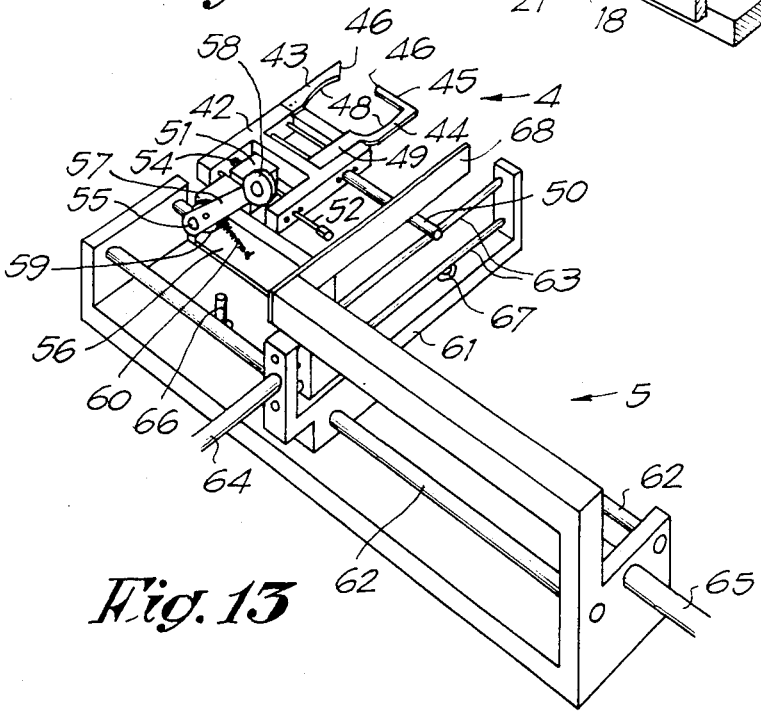
FIG. 13 represents the pair of fibre-gripping tongs of FIG. 1 in another position.

The pair of fibre-gripping tongs 4, as shown in FIG. 13, consists of a body 42 to which a fixed jaw 43 and a movable jaw 44, which is practically parallel to the latter, are fixed. The movable jaw 44 is provided at its free end with a square part 45 so that the points 46 of said jaws 43 and 44 abut against one another when the pair of fibre-gripping tongs 4 is closed. The points 46 of jaws 43 and 44 are not in the same plane, but are mounted in such a way that they overlap each other in the closed position of the pair of fibre-gripping tongs 4 and a lateral contact is formed by their points 46 so that no fibers can fall between them.

The points 46 can be levelled off at an angle of say 45°, whereby the jaws 43-44 can easily penetrate under and behind the fibres that are the bundle chamber 16, as will follow from the further description of the operation. Preferably, the bottom 21 is to be provided with a slot 47 so that the fixed jaw 43 is partly or completely recessed in said slot 47 when the fibres are embraced and gripped in the bundle chamber 16.

The inside walls 48 of the fixed jaw 43 and the movable jaw 44 facing each other, in the embodiment according to the fixtures have a slightly bent shape, all this in such a way that the space enclosed by the pair of fibre-gripping tongs 4 in its closed position is more or less convex.

The movable jaw 44 is fixed to a slide 49 which can slide in or along the body 42 and which is operated by means of a piston cylinder 50. The body 42 which is mounted on a revolving pad 51 can be rotated over 90° so that the plane wherein the jaws 43 and 44 are active can take a vertical as well as a horizontal position. Said jaws 43-44 are mounted on the body 42 in such a way that in the vertical position of the pair of fibre-gripping tongs 4, the fixed jaw 43 is at the bottom.

By means of an adjusting screw 52 it is possible to adjust the body 42 with respect to the revolving pad 51. For body 42 is mounted slidably on the revolving pad 51 via the guiding rods 53, the mutual position of both these parts being determined by the aforementioned adjusting screw 52 and a spring 54.

By means of a spindle 55 fixedly attached to the revolving pad 51, the latter is rotatably mounted in a part, viz. the top slide 56 of the conveyor part 5. The spindle 55 at its other end is provided with a crank element 57, which at its end bears a small roller 58 and midway of its length a fixed small wheel 59. To the latter a spring 60 is attached that runs partly over said wheel 59 and with its other end is fixed to the top slide 56, all this in such a way that under the influence of the spring force of this spring 60, the crank element 57 and thus also the pair of fibre-gripping tongs 4 are subjected to a torque F. A number of stops, that still are to be specified further in the description, make that the parts concerned can rotate over only 90°.

The conveyor part 5 consists mainly of a bottom slide 61 and an already mentioned top slide 56 which are square with one another and are allowed to slide in a horizontal plane over bars 62 and 63 respectively and which can be operated, e.g. by means of the piston cylinders 64 and 65 respectively. Moreover, in the slideway of both the bottom slide 61 and the top slide 56 stops 66 and 67 respectively are mounted, which preferably are operated electromagnetically.

Both of the outermost positions of the bottom slide 61 are situated such that on the one hand in the outermost left position, at least according to the embodiment of FIG. 1, the pair of fibre-gripping tongs 4 finds itself before the fibre magazine 6 and that on the other hand, in the outermost right position, the latter finds itself in front of the bundle casing 16, at least if the latter is in its left position.

In the aforementioned outermost positions, the pair of fibre-gripping tongs 4 can be brought in and out the fibre magazine 6 and the bundle chamber 16 respectively by shifting the top slide 56, the pair of fibre-gripping tongs 4 in the first case being horizontal and in the second case being vertical.

In the vertical position of the pair of fibre-gripping tongs 4, the roller 58 presses against a stationary stop bar 68, whereas in the horizontal position, a suitable stop prevents any further rotation. The stop bar 68 is long enough so that it can be active over the entire stroke of the top slide 56.

The fibre magazine 6 making part of a brush-making machine can be of any type. According to the embodiment represented here, this fibre magazine consists of two horizontal fibre channels 69 lying side by side, wherein the loose fibres 70 have to be placed. Further, slides 73 are provided that are movable by means of piston cylinders 71 and piston rods 72, to which revolving hold-down elements 74 are mounted. Some stops and springs—which are not represented in the figures—make that these hold-down elements 74 are held in the position by spring pressure as represented in the figure, and that they can be rotated out of the channel against the action of the spring.

The operation of the feeding arrangement for fibre magazines of brush-making machines, as represented schematically in FIG. 2, consists mainly of successively putting a fibre bundle 13 into the bundle chamber 16; bringing it under the paper gripper 3; cutting and removing the wrapper 75; removing the now loose fibre bundle by means of the pair of fibre-gripping tongs 4; and placing the fibres 70 into the fibre magazine 6.

The operation is explained more detailedly hereinafter, especially by means of the FIGS. 3 to 8.

Figure 3:
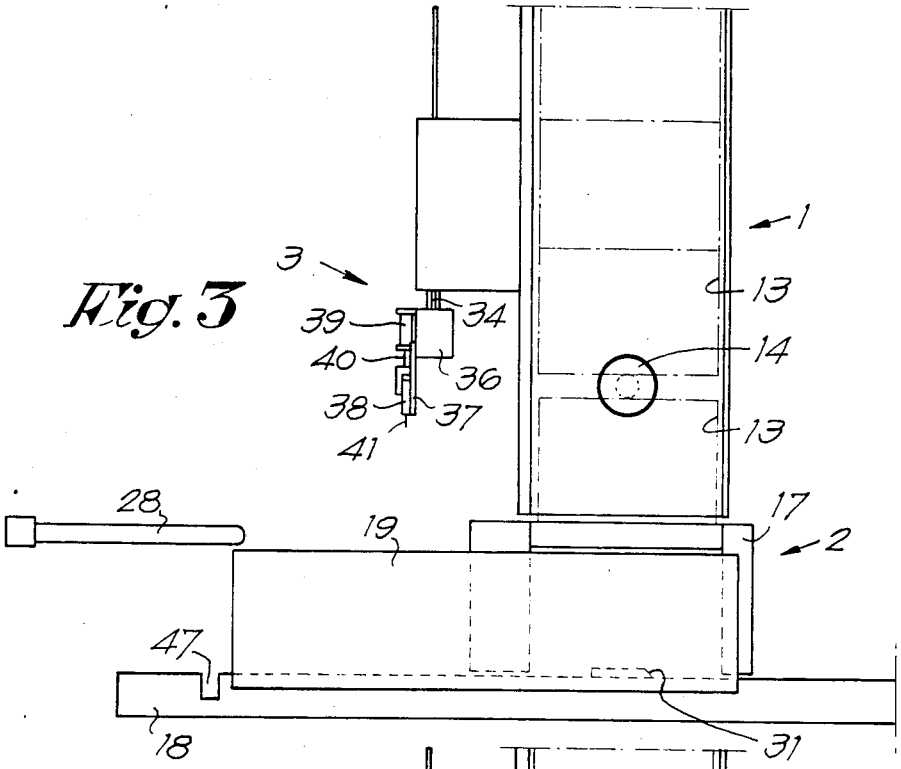

First of all, the knife 31, which is still in its final position from the foregoing cycle, as represented in FIG. 3, is reset in its initial position.

In this initial position the main slide 17 and the intermediate slide 19 are at right, whereas the bottom slide 18 is at left. At the same time, stop 28 is located in the protruding position.

Figure 4:
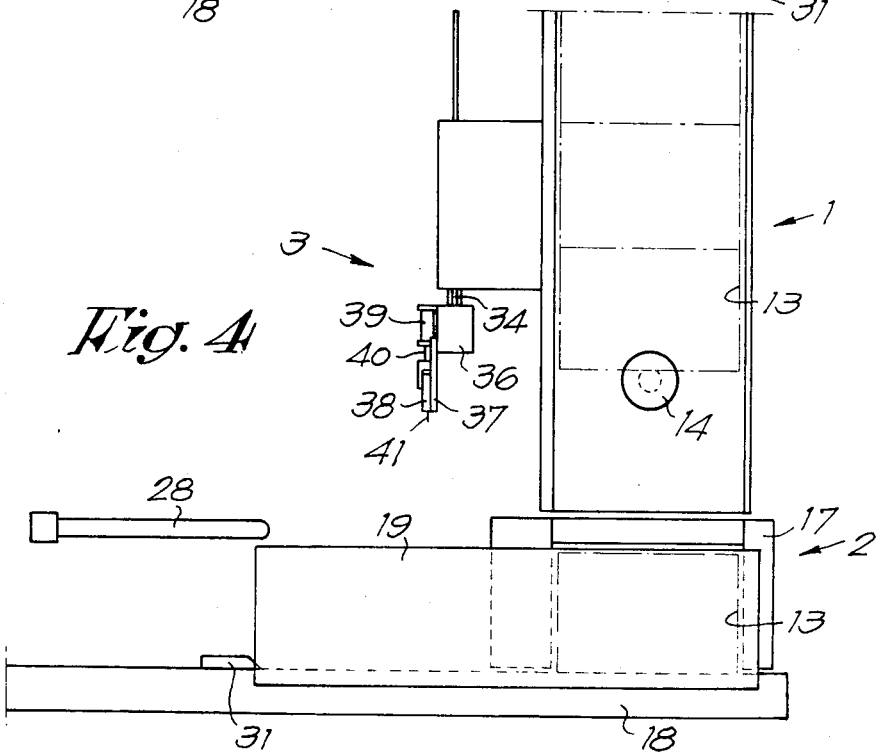
Figure 5:
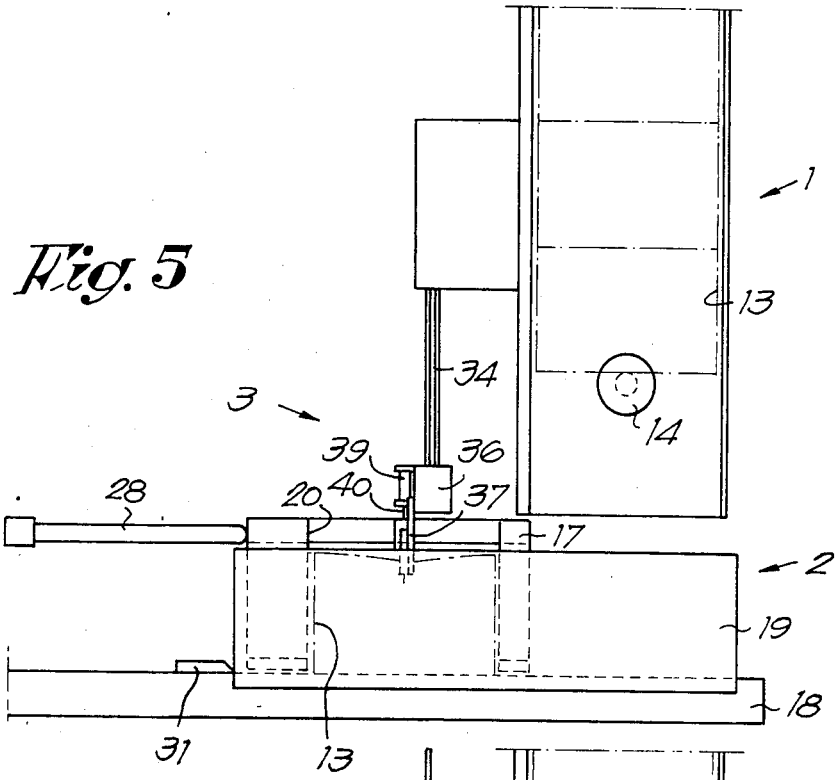
Figure 6:
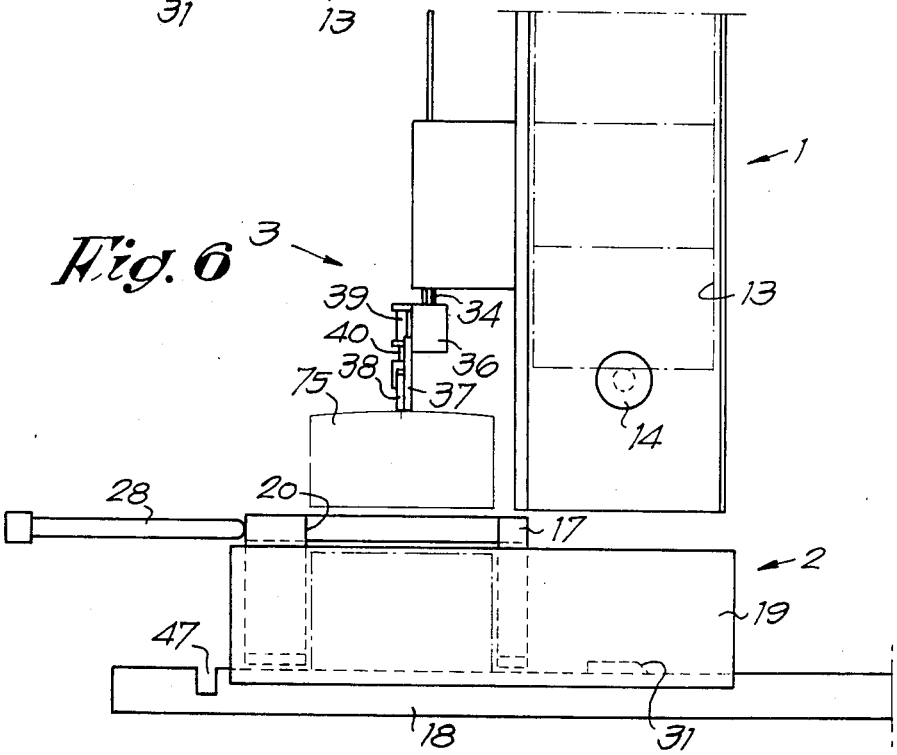
Figure 9:
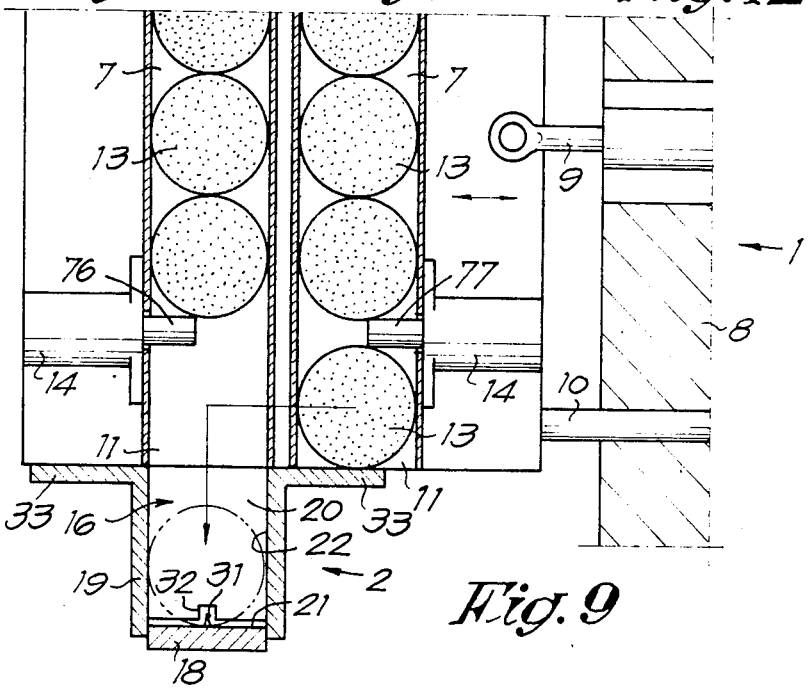
FIG. 9 represents an embodiment of the bundle magazine.

As is represented in FIGS. 4 and 9, just one fibre bundle is brought to the bundle chamber 16 by means of the stopping mechanism 1.

The operation of said stopping mechanism 14 is represented explicitly in FIG. 9 for a bundle magazine 1 having two bundle channels 7. The piston rod 9 and the bundle magazine 1 can occupy two positions. Each of the bundle channels 7 is provided with stops that can be operated and that consist of the pins 76 and 77 which are active in the left and the right bundle channel respectively. In the normal situation both pins 76-77 form a stop for the fibre bundles 13. As soon as a determined kind of fibres has to be filled up in the fibre magazine 6, the following will occur. If, e.g., fibres from the right-hand channel are required, bundle magazine 1 places itself in its right position. Pin 76 prevents the fibre bundles 13 from the left bundle channel 7 from falling into the bundle chamber 16. Thereupon pin 77 is retracted, whereby the undermost fibre bundle from the righthand bundle channel 7 will lie on the right-hand flange 33, whereafter pin 77 goes out again, all this in such a way that after this operation just one bundle casing 13 finds itself under this pin 77, as represented in FIG. 9. Thereafter, the piston rod 9 moves to the left, whereby the right-hand bundle channel 7 comes above the bundle chamber 16, the desired fibre bundle thereby falling into the bundle chamber 16 at last.

Then the bundle chamber 16 moves to the left as far as the stop 28 and thus as far as just under the paper gripper 3, whereafter the latter goes down. The paper gripper 3 first properly compresses the fibre bundle 13 against the bottom 21 (FIG. 5) and practically simultaneously the bottom slide 18 goes to the right, whereby the knife 31 cuts the wrapper 75 through. When the paper gripper 3 goes up again, it takes along the cut through wrapper 75 (FIG. 6), while the loose fibres thereof are left in the bundle chamber 16.

Figure 10:
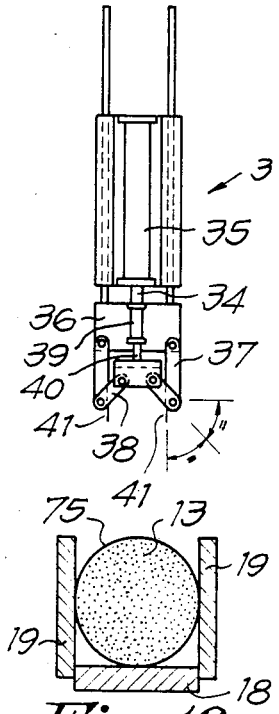
FIGS. 10 to 12 represent several phases of the operation of a paper gripper according to the present invention.
Figure 11:
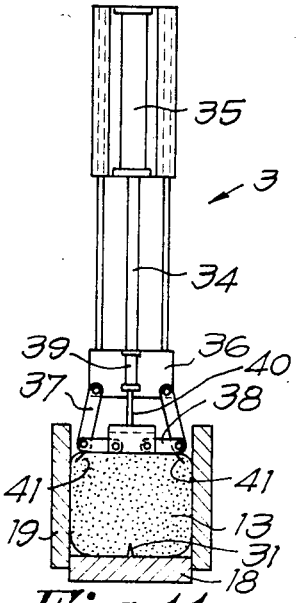
Figure 12:
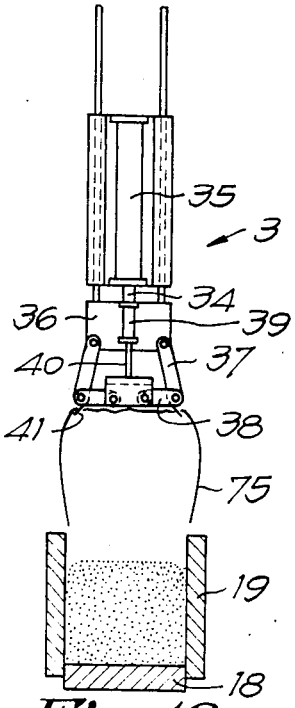

The gripping action of the paper gripper 3 in the wrapper 75 is clearly represented in FIGS. 10 to 12. First the piston rod 34 comes out, whereby the element 36 as well as the rods 37-38 attached thereto move down (FIG. 10). The vertically directed small pins 41 penetrate into the wrapper 75 and the undersides of the rods 35 firmly compress the fibre bundles 13 in the bundle chamber 16 under the influence of the pressure force of the piston cylinder 35. Optionally at the same time with cutting through wrapper 75, the second piston cylinder 39 comes out, whereby the rods 38, which before made an angle of 45° with respect to the horizontal, are now lying horizontally, whereby the pins 41 formerly standing vertically are now pointing outward (FIG. 11).

In the given situation it is impossible for the wrapper 75 to get loose from these pins 41. In this way the paper gripper 3 according to the present invention upon moving upward can remove the wrapper 75 in a reliable way (FIG. 12).

The paper-removing arrangement not represented in the drawings will remove the wrapper 75 hanging on the pins 41 and carry it away to a scrap receptacle.

Figure 7:
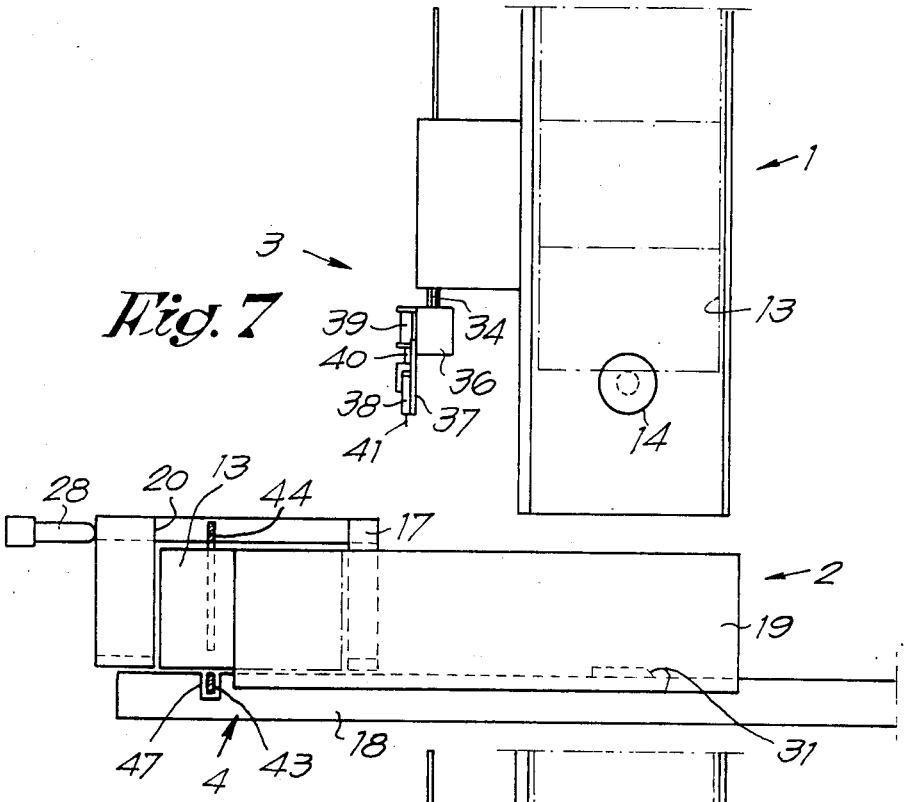
Figure 8:
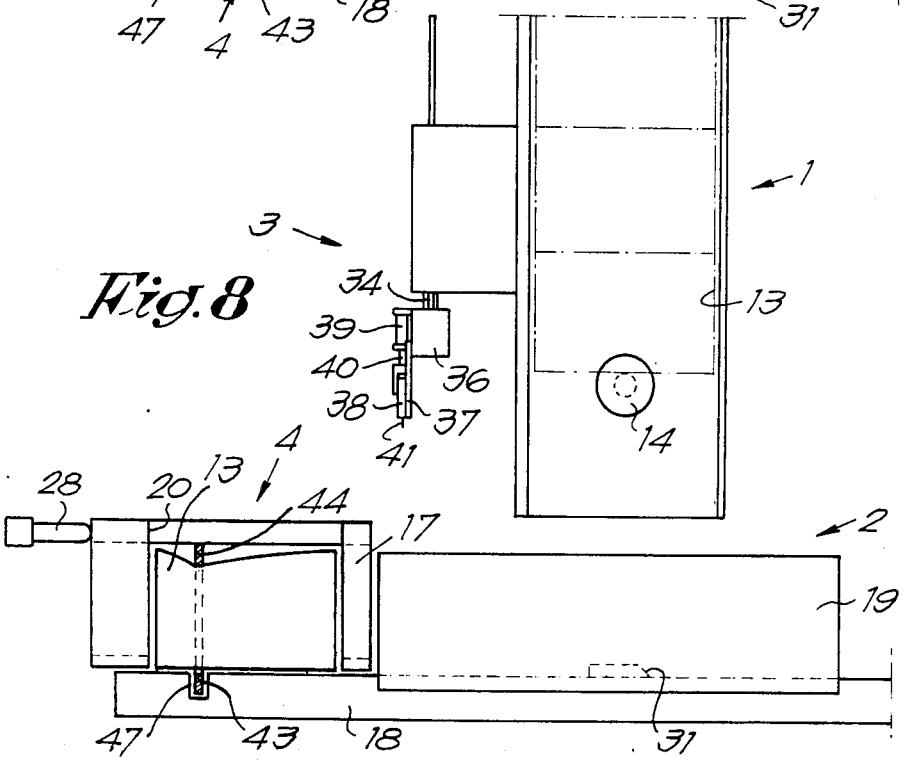

Thereafter the stop 28 is withdrawn so that the bundle chamber 16 slides further to the left as represented in FIG. 7, all this in such a way that the latter still partly finds itself between the sidewalls 22, for otherwise the loose fibres would fall from the bundle chamber 16.

Now the conveyor part 5, whose bottom slide 61 is in the uttermost right position for the moment, comes into action.

Thereupon, top slide 56 is moving to the bundle chamber 16 as far as against stop 67, whereafter the open pair of fibre-gripping tongs 4 penetrates into the bundle chamber 16, the fixed jaw 43 sliding thereby through slot 47 in the bottom 21 under the loose fibres. Then slide 49 is moved down, whereby the movable jaw 44 moves towards the fixed jaw, so that the loose fibres are compressed between the inside edges 48 facing one another.

Hereby, according to the present invention the fibres are gripped off their centre so that—as will be described below—the jaws 43-44 of the pair of fibre-gripping tongs can easily pass above the fibre magazine 6, whereas on the other hand the major part of the fibres yet finds itself in one of the fibre channels 69 themselves.

The top slide 56 slides back to its original position, whereby the pair of fibre-gripping tongs 4 takes the loose fibres from the bundle chamber 16. It is clear that in the aforesaid operation the pair of fibre-gripping tongs 4 is in its vertical position and that such is realized thereby that the roller 58 slides over the stop bar 68.

Then the bottom slide 61 slides to the left up to, either the then protruding stop 66, or up to the left end of rods 62, whereby in the latter case said stop 66 is thus withdrawn, all this in such a way that the pair of fibre-gripping tongs finds itself before the right or left fibre channel of the fibre magazine 6 depending on the control of said stop 66.

Meanwhile, roller 58 has left the stop bar 68 and the pair of fibre-gripping tongs 4 has occupied a horizontal position under the influence of the gripping force of spring 60, as represented in FIG. 13. When the pair of fibre-gripping tongs 4 is staying before one of the fibre channels 69 of fibre magazine 6, the stop 67 goes in, whereupon by the forward movement of the top slide 56, the fibres finding themselves in the pair of fibre-gripping tongs 4 are pressed up to the rearside of one of the hold-down elements 74. Then slide 73 of the fibre channel concerned is moved backward, whereby the hold-down element 74 pivots out between the fibres and is entered again immediately behind the bundle just placed. Meanwhile, roller 58 has left the stop bar 68 and the pair of fibre-gripping tongs 4 has occupied a horizontal position under the influence of the spring force of spring 60, as represented in FIG. 13. When the pair of fibre-gripping tongs 4 is staying before one of the fibre channels 69 of fibre magazine 6, the stop 67 goes in, whereupon by the forward movement of the top slide 56, the fibres finding themselves in the pair of fibre-gripping tongs 4 are pressed up to the rearside of one of the hold-down elements 74. Then slide 73 of the fibre channel concerned is moved backward, whereby the hold-down element 74 pivots out between the fibres and is entered again immediately behind the bundle just placed. Slide 73 is then again pushed forward by means of piston cylinder 71 belonging to it, whereupon the pair of fibre-gripping tongs 4 opens and the new bundle of fibres closes up to the fibres 70 that were already present in the fibre channel 69 concerned.

By means of piston cylinder 71 the hold-down element 74 exerts a permanent pressure on the loose fibres 70 contained in fibre channels 69 so that the brush-making machine is enabled to constantly take up fibres. It is clear that the conveyor part 5 returns itself to its initial position after its action.

It is also clear that for controlling the automatic feeding arrangement for brush-making machines as well as all the composing parts, among other things the slides and the various stops, adjusting arrangements known by themselves can be applied. E.g., a detection arrangement is mounted on slide 73 in such a way that at the required moment, i.e. at the moment of an approaching lack of fibres 70, the feeding arrangement comes into operation, and that the feeding arrangement will interrupt its operation if all the fibre channels 69 are filled.

All the movable stops used may be of the pneumatic as well as of the electromagnetic type.

For in a variant, all slides can be electrically driven.

Preferably, as has been mentioned, a pair of fibre-gripping tongs 4 is used whose jaws 43 and 44 have a bent inside face 48 whereby the original cylindrical fibre bundles 13, which in the bundle cassette under the pressure of the paper gripper 3 have already been preformed a first time, upon being gripped are flattened and thus deformed to a rectangular or practically rectangular and also partly convex form. At the one hand this deformation has the advantage that the loose fibres, that sometimes slightly stick together upon being gripped, are suitably loosened from one another so that no problems arise later upon the take-up of said loose fibres 70 in the fibre magazine 6. On the other hand, this form ensures the easy feeding of the fibre pack into fibre channels 69.

It is clear that upon using fibre bundles 13 that are provided with another type of wrapper 75, the paper gripper 3 is replaced by another arrangement. If the fibre bundles 13 e.g. are held together by small ropes or rubber bands, the paper gripper 3 is replaced by an automatic device which grips the rope or the like and carries it off.

According to an embodiment for removal of a wrapper 75 such as rubber bands, small threads, ropes or the like, this device consists of an elongated small element that is bent at its end over 180° in such a way that the bent end over a determined length runs parallel to the proper body of said element, both parts joining each other or nearly joining each other. By making this element longitudinally brush suitably over a fibre bundle, the wrapper 75 consisting of a rubber band, a small thread, a small rope or the like, gets caught between both parts thereof, i.e. between the body and the bent end. Then the wrapper is cut through, e.g. at the bottom of the fibre bundle. The wrapper 75 cut through and held down between the parts of said small element can now simply be carried off by this device.

According to the preferred embodiment, the bent end consists of a resilient material and is rounded off or levelled off a little at its point so that the wrapper can easily penetrate between the body and the bent, and is held down tightly between both parts under the pressure of the resilient end.

As the position of a number of loose fibres can be distributed by pulling the wrapper 75 from below during the taking-away of the latter, so that a number of fibres comes in disorder and the proper functioning of the feeding arrangement may be prejudiced, the preferred embodiment of the paper gripper 3 or the like is provided with a vibration mechanism such that the wrapper is removed from the fibre bundle with a shaking or vibrating motion. In its simplest embodiment such is performed by allowing piston rod 34 of piston cylinder 35 to enter with a discontinuous shaking motion. A variant thereof provides in making the whole gripping device vibrate, either thus paper gripper 3 in the case of a paper wrapper 75, or another gripping device in the case of another kind of wrapper.

In order to exclude the above problem, another variant provides a plate which is slid between said wrapper and the loose fibres during the removal of said wrapper 75—thus just after piston rod 24 has started to slide into piston cylinder 35—in such a way that the fibres cannot be pulled upward and thrown into disorder by the wrapper that is being removed. Preferably, this plate has a pointlike shape so that it can easily slide between the wrapper 75 being removed and the fibre pack.

A still further variant deals with the use of a feeding arrangement that is equipped with both a vibration mechanism and a plate as described above.

Obviously, the arrangements mentioned above can be used for paper gripper 3 as well as for any other gripping device for wrapper 75 of fibre bundles 13.

Upon using long fibre packs that have not yet been cut to the desired length, an automatic cutting arrangement can be provided before the fibre-bundle magazine 1 for obtaining said fibre bundles 13.

The arrangement forming the object of the present invention can be used in single- as well as in multiple fibres magazines, that can be of both the fixed and the oscillating type.

In a more extended variant such a feeding arrangement is also usable in multiple brush-making machines wherein thus only one feeding arrangement is liable for the several single- or multiple fibre magazines.

According to a variant with an adapted conveyor part 5, one single feeding arrangement can also be used for several individual brush-making machines, which e.g., are arranged in series.

Obviously, the feeding arrangement described above for feeding a fibre magazine 6 can be used in a variant as a loose unit that either can be connected to existing machines, or can be used separately for filling single fibre cassettes.

The present invention is by no means limited to the embodiment described by way of example and represented in the accompanying drawings. Such feeding arrangement for fibre magazines and/or fibre cassettes as well as the composing parts thereof can be realized in any shape and dimensions without departing from the scope of the invention.

What is claimed:

1. An arrangement for the automatic feeding of loose fibres to the fibre cassette of a brush-making machine, which arrangement comprises:

(a) a bundle magazine which stores and dispenses cylindrical fibre bundles that include loose fibres secured together by a wrapper;

(b) a bundle chamber which sequentially receives and encloses each fibre bundle dispensed from the bundle magazine;

(c) a knife disposed within the bundle chamber, which cuts through the wrapper of each fibre bundle;

(d) means for completely removing each cut wrapper from the loose fibres of each fibre bundle;

(e) tongs which grip and maintain the loose fibres in a parallel disposition after removal of the cut wrapper; and (f) conveying means for bringing the fibres gripped by the tongs to the fibre cassette of the brush-making machine for placement therein.

2. The arrangement of claim 1 wherein the bundle chamber includes a main slide defining a pair of end walls, a bottom slide defining a bottom, and an intermediate slide defining side walls of the chamber.

3. The arrangement of claim 2 wherein the knife is carried by the bottom slide, so that movement of the bottom slide causes the knife to cut through the wrapper of a fibre bundle disposed within the chamber.

4. The arrangement of claim 2 wherein the bottom slide includes a slot which receives a portion of the tongs during gripping of the loose fibres disposed within the bundle chamber.

5. The arrangement of claim 2 wherein the side walls of the bundle chamber each include an outwardly extending horizontal flange which supports a fibre bundle within the bundle magazine.

6. The arrangement of claim 2 wherein the main slide includes means for correlating the length of the bundle chamber to the length of the fibre bundle.

7. The arrangement of claim 2 wherein the bottom slide and the intermediate slide are movable between two outermost positions, and further including stop means for disposing the main slide in an intermediate position.

8. The arrangement of claim 1 wherein the bundle magazine includes at least one bundle channel and an abutting mechanism associated with the channel which controls dispensing of the fibre bundles.

9. The arrangement of claim 1 wherein the tongs include a body, and a fixed jaw and a movable jaw carried by the body.

10. The arrangement of claim 9 wherein the movable jaw includes a free end defined by a right angled portion that is movable towards the fixed jaw upon closure of the jaws for gripping the loose fibres.

11. The arrangement of claim 10 wherein the right angled portion of the movable jaw is disposed so that it partly overlaps the fixed jaw, which permits terminal ends of the jaws to laterally engage against each other.

12. The arrangement of claim 9 further including a revolving pad, and the body being slidably secured to the revolving pad.

13. The arrangement of claim 12 further including means for adjusting the position of the body with respect to the revolving pad.

14. The arrangement of claim 1 wherein the conveyor means includes a bottom slide and a top slide, with the tongs being carried by the top slide.

15. The arrangement of claim 14 wherein the tongs are movable between the bundle chamber and the fibre cassette, the tongs being mounted for rotation over 90°, and further including stop means for disposing the tongs vertically when positioned before the bundle casing and horizontally when positioned before the fibre cassette.

16. The arrangement of claim 15 further including a fixed stop bar, a crank element, a roller carried by the crank element which engages the stop bar, a spring which biases the crank and roller away from engagement with the stop bar, so that when the tongs is disposed vertically before the bundle chamber the roller are in engagement with the stop bar.

17. The arrangement of claim 1 wherein the means for completely removing each cut wrapper includes a movable element, a first piston rod and cylinder assembly for moving the element in a vertical direction, two pairs of pivotal rods carried by the element, a second piston rod and cylinder assembly carried by the element, the second piston rod being connected to the pivotal rods, and at least one pair of downwardly directed pins mounted to the pivotal rods, so that the pins are swung outwardly during operation of the second piston and cylinder assembly.

* * * * *